United States Patent [19]

Neumann et al.

[11] Patent Number: 4,621,422

[45] Date of Patent: Nov. 11, 1986

[54] METHOD OF MANUFACTURING CONTACT SPRING SOCKETS

[75] Inventors: Gerhard Neumann, Waldkraiburg; Hans Ramisch, Mühldorf, both of Fed. Rep. of Germany

[73] Assignee: Otto Dunkel GmbH Fabrik fur Elektrotechnische Gerate, Muhldorf, Fed. Rep. of Germany

[21] Appl. No.: 718,448

[22] Filed: Apr. 1, 1985

[30] Foreign Application Priority Data

Apr. 5, 1984 [DE] Fed. Rep. of Germany ..... 3412874

[51] Int. Cl.[4] ..... H01R 43/04

[52] U.S. Cl. ..... 29/882; 339/256 R

[58] Field of Search ..... 29/874, 876, 882, 446, 29/511, 525; 339/256 R, 256 RT, 256 S, 256 T

[56] References Cited

FOREIGN PATENT DOCUMENTS

| | | | |
|---|---|---|---|
| 1113023 | 8/1961 | Fed. Rep. of Germany | 339/256 R |
| 1118303 | 11/1961 | Fed. Rep. of Germany | 339/256 R |
| 1263893 | 3/1968 | Fed. Rep. of Germany | 339/256 R |
| 340878 | 10/1959 | Switzerland | 339/252 P |

*Primary Examiner*—Howard N. Goldberg
*Assistant Examiner*—Carl J. Arbes
*Attorney, Agent, or Firm*—Holman & Stern

[57] ABSTRACT

A method relates to manufacturing contact spring sockets with a plurality of contact springs, clamped at one end in an approximately cylindrical thin-walled socket body and bowed radially inward. The straight contact springs are introduced in the socket body into the annular space between a mandrel and the socket wall and subsequently when in an aligned state relative to each other are pressed against an annular head at the front end of the line connector which partly projects into the socket body and are made fast in this position at one end. Deformation of the socket body for elastically bowing the contact springs can be omitted according to the invention, if after introduction of the contact springs into the annular space of the socket body an insert ring (10) is introduced into the latter fitting adjacent the socket innner wall, whose internal diameter is smaller than the external diameter of the annulus plus twice the diameter of the contact springs. By these means the insert ring with its inner end edges presses radially inward on the contact springs. At their ends away from the pin insertion opening they are pressed radially outwards by the subsequent introduction of the conically formed front end of the line connector, before they are made fast by clamping and folding over of the socket edge against the connector.

3 Claims, 5 Drawing Figures

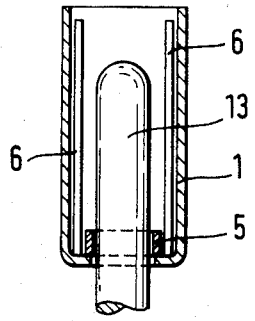
FIG. 1
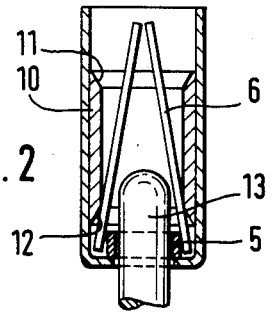
FIG. 2
FIG. 3
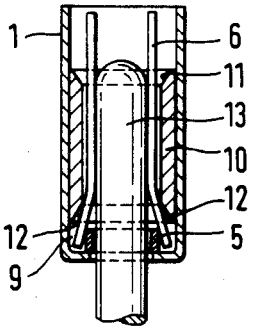
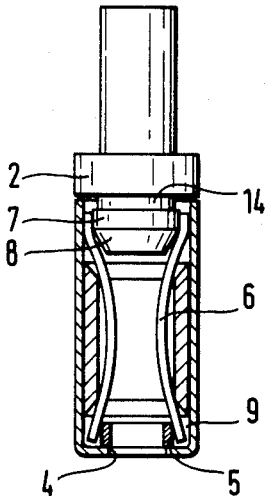
FIG. 4
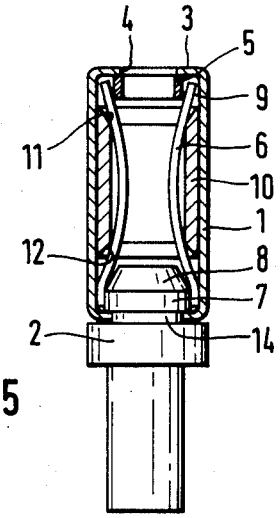
FIG. 5

METHOD OF MANUFACTURING CONTACT SPRING SOCKETS

BACKGROUND OF THE INVENTION

This invention relates to a method of manufacturing contact spring sockets with a plurality of radially inward bowed contact springs clamped at one end in an approximately cylindrical socket body, formed by a thin-walled deformable sleeve, wherein firstly a mandrel is co-axially introduced into the socket body at the pin insertion end, which together with the socket body defines an annular space and centres an annulus introduced into the socket body, wherein subsequently straight contact springs, formed by sections of a contact spring wire, are introduced into the annular space in the socket body from the end remote from the pin insertion end, until with their front ends they come to lie in the annular gap between the annulus and the socket body, wherein the contact springs when in an aligned state relative to each other are pressed against an annular head at the front end of the line connector which partly projects into the socket body and are made fast in this position at one end whereby they are so radially elastically deformed, that their free ends which extend to the ring gap adjacent the pin insertion opening are guided freely movable therein.

A method of this type which belongs to the state of the art, according to which contact spring sockets of particularly small construction can be manufactured, is described in the German Patent application P33 42 742.9-34 which has not been published as of the filing date of the present application. This method uses sleeves with a wall thickness of 0.1 mm, economically prefabricated by drawing, which can easily be deformed from outside. After introduction of the contact springs the sockets are provided with a radially inward projecting annular indentation at each of two spaced apart regions axially offset relative to the annulus and the annular head respectively. These annular radial indentations press on the contact springs and bow them radially inward.

In this manner contact pins of only about 0.6 mm diameter can be provided with sockets with an external diameter of only about 1.5 mm. Thus an extraordinarily large number of contact spring sockets can be arranged next to each other in a very small space, and thereby high quality multicontact connectors can be produced at low cost.

In this method of manufacture the degree of deformation of the socket body determines the size of the annular indentations and thus the bowing of the contact springs, on which in turn the contact force depends.

SUMMARY OF THE INVENTION

According to the present invention it has been shown, that deformation of the socket body to form the annular indentations can be omitted, if after introduction of the contact springs into the annular space of the socket body an insert ring is introduced into the latter fitting adjacent the socket inner wall, whose internal diameter is smaller than the external diameter of the annulus plus twice the diameter of the contact springs, so that the insert ring with its inner end edges presses radially inward on the contact springs, while at their ends away from the pin insertion opening they are pressed radially outwards by the subsequent introduction of the conically formed front end of the line connector, before they are made fast by clamping and folding over of the socket edge against the connector.

It has proved particularly suitable for swift manufacture particularly of very small contact spring sockets, if the mandrel after introduction of the contact springs into the annular space is first partially withdrawn, and then after introduction of the insert ring is again inserted into the socket body and after making fast the contact springs removed completely from the socket body.

For the manufacture of miniaturized contact spring sockets it is of advantage, if the spacing of the abutment points of the insert ring which press radially inward on the contact springs is predetermined by chamfering the inner end edges of the insert ring prior to its introduction into the socket body.

BRIEF DESCRIPTION OF THE DRAWINGS

Further details, advantages and features of the invention emerge from the following description and the drawing, to which express reference is made as regards all details not described in the text.

There is shown in:

FIGS. 1 to 4 schematically show the method steps of the method according to the invention, and FIG. 5 shows a contact spring socket made according to the method of the invention.

DETAILED DESCRIPTION OF THE INVENTION

As can be seen from the drawings, the contact-spring socket illustrated in FIG. 5 comprises an approximately cylindrical socket body 1 in the form of a thin-walled deformable sleeve. This socket body 1 is connected to a line connector 2. On its opposite end the socket body 1 has a flange 3 with a central pin insertion opening 4. In the region of this pin insertion opening an annulus 5 abuts the flange 3, whose inner diameter is chosen to be somewhat smaller than the pin insertion opening 4 provided in the socket body 1. A plurality of contact springs 6 is arranged around the internal circumference. These contact springs 6 are fixed at one end between an annular head 7 of line connector 2 projecting into the socket body 1, which at its front end terminates in a conical frustum 8, and the end of socket body 1 facing line connector 2. The other ends of contact springs 6 which face the pin insertion opening of socket body 1 are guided freely movably in an annular gap 9 between the socket body and the annulus 5. The inward bowing of contact springs 6 shown in FIG. 5, is achieved by introducing into socket body 1 an insert ring 10 fitting adjacent the interior wall of the socket, whose internal diameter is smaller than the external diameter of the annulus 5 plus twice the diameter of the contact springs 6. This insert ring 10 with its two inner end edges 11 and 12 presses on the contact springs 6 radially from inside. The contact springs 6 press on these two end edges 11 and 12, which edges are displaced axially relative to annulus 5 or annular head 7 respectively. They cause them to be elastically deformed radially inward.

In a variation of the normal form of annulus 5 shown in the drawing, it could on its side facing the contact-pin insertion opening also be formed with a flange of larger diameter which correspondingly enlarges the abutment surface, whose outer diameter is however chosen to be smaller than the internal diameter of the contact spring socket 1.

As can be seen from FIG. 4 or 5 respectively, the internal diameter of the annulus 5 is chosen to be larger than the smallest distance apart in the middle of the socket of those bowed contact springs which lie in any one plane parallel to the socket axis. The annulus 5 which is introduced loosely into socket body 1 before the introduction of the contact springs 6, is after assembly held by the contact spring ends abutting it. On the basis of the above mentioned dimensional relations perfect mutual contact is ensured even if a contact pin should be introduced into the contact spring socket with slight offset of its axis. For in that case annulus 5 together with the contact springs abutting it can give way sideways.

In FIGS. 1 to 4 there are schematically illustrated the steps used in the manufacturing method according to the invention. First the socket body 1 is positioned ready, and this by means of a mandrel 13 which passes through the pin insertion opening 4. Then, as shown in FIG. 1, the annulus 5 is introduced into the socket body 1, and this in such a manner that it surrounds the mandrel 13. In this schematic representation the annulus 5 is as shown in FIGS. 1 to 5. Instead the above mentioned modified annulus could be used, which is provided with a flange on its side facing contact pin insertion opening 4 which flange provides a larger abutment surface.

In a further step with the aid of delivery apparatus not shown in detail the contact springs 6 are introduced into the annular space between mandrel 13 and socket body 1. In the further step illustrated in FIG. 2, mandrel 13 is partly withdrawn from socket body 1, so that the contact springs 6 permit the introduction adjacent the interior wall of the socket of insert ring 10, in that they give way by moving centrewards. By subsequent renewed introduction of mandrel 13 (see FIG. 3) the contact springs 6 are elastically deformed and positioned approximately parallel to each other along the outside of mandrel 13. Their ends take up an approximately annular position, and the diameter is large enough to permit introduction of the conical front end 8 of line connector. The contact springs 6 are held fast in their inserted deformed position, because the line connector 2 after introduction of its annular head 7 into the space defined by the upper ends of the contact springs 6, which is facilitated by the conical frustum 8 on the annular head 7, is fastened to the socket body 1 by bringing to bear exterior pressure on the latter with simultaneous folding over of the socket edge, FIG. 4, and this after removal of mandrel 13. As further indicated in this Figure, an annular groove 14 is provided at the base of annular head 7, into which the upper folded over edge of socket body 1 extends.

In the finished state illustrated in FIG. 5, the prescribed functional tests on the contact spring socket can be carried out.

What is claimed is:

1. A method of making contact spring sockets, comprising the steps of:

providing a socket body having a flange at a first end of said socket body; said socket body having a generally hollow interior; said flange having an inner periphery surrounding an opening communicating with said hollow interior; said socket body having an open second end;

providing a mandrel adapted to enter said opening;

inserting said mandrel into said opening;

providing an annulus adapted to allow entry of said mandrel;

inserting said annulus into said hollow interior and passing said annulus about said mandrel;

moving said annulus along said mandrel until said annulus abuts said flange;

providing at least one elongated contact spring; said at least one elongated contact spring having a first end, a second end, and a central portion;

inserting said at least one elongated contact spring into said hollow interior until said first end of said at least one elongated contact spring is disposed between an outer periphery of said annulus and an inner surface of said socket body;

providing an insert ring adapted to be received within said hollow interior;

inserting said insert ring into said socket body, between said at least one elongated contact spring and said inner surface of said socket body, until an end of said insert ring causes angular displacement of said second end of said at least one elongated contact spring relative to said first end, such that said second end is moved away from said inner surface;

elastically deforming said at least one elongated contact spring against an inner surface of said annulus;

providing a line connector having a conical frustrum;

inserting said conical frustrum of said line connector into said open second end of said socket body until contacting said second end of said at least one elongated contact spring;

continuing to insert said conical frustrum into said socket body until said second end of said at least one elongated contact spring abuts said inner surface of said socket body;

deforming said socket body in a region adjacent said open second end to form a shoulder to retain said conical frustrum of said line connector in said socket body.

2. A method as claimed in claim 1, further comprising:

before the step of providing an insert ring, partially withdrawing said mandrel from said hollow interior; and after the step of inserting said insert ring, moving said mandrel further into said hollow interior; and after the step of deforming said socket body, withdrawing said mandrel entirely from said hollow interior.

3. A method as claimed in claim 1, including providing said insert ring with a beveled leading end sufficient to cause radially inward movement of said second end of said at least one elongated contact spring during the step of insertion of said insert ring.

* * * * *